United States Patent [19]

Huperz et al.

[11] 4,216,911

[45] Aug. 12, 1980

[54] HIGH-PRESSURE LIQUID-JET GUN

[75] Inventors: Adalbert Huperz, Hockenheim; Wolfgang Maasberg, Hünxe-Krudenburg, both of Fed. Rep. of Germany

[73] Assignee: Woma Apparatebau Wolfgang Maasberg & Co. GmbH, Duisburg, Fed. Rep. of Germany

[21] Appl. No.: 8,763

[22] Filed: Feb. 1, 1979

[30] Foreign Application Priority Data

Feb. 4, 1978 [DE] Fed. Rep. of Germany ..... 2804844

[51] Int. Cl.[2] ..... B05B 11/00; B05B 7/02

[52] U.S. Cl. ..... 239/526; 42/70 G; 251/99; 251/109

[58] Field of Search ..... 239/526-528; 251/95, 98, 99, 103, 104, 108, 109, 113, 115, 116; 42/70 R, 70 G

[56] References Cited

U.S. PATENT DOCUMENTS

| | | | |
|---|---|---|---|
| 3,913,844 | 10/1975 | Petrovic | 239/526 |
| 3,944,141 | 3/1976 | Siczek | 239/526 X |
| 4,105,164 | 8/1978 | Lau et al. | 239/526 |
| 4,166,579 | 9/1979 | Beise et al. | 239/526 |

FOREIGN PATENT DOCUMENTS

| | | | |
|---|---|---|---|
| 2238019 | 2/1974 | Fed. Rep. of Germany | 239/526 |

*Primary Examiner*—Robert W. Saifer
*Attorney, Agent, or Firm*—Karl F. Ross

[57] ABSTRACT

A high-pressure liquid-jet gun has a pistol-type housing provided with a valve having an actuation member displaceable between a closed position and an open position to release liquid from an end of the housing. A safety lever is displaceable on the housing between a safety position relatively far from the barrel of the housing and a use position lying against this barrel. A spring urges this safety lever into the safety position. A trigger is pivoted on the safety lever and has a formation which is engageable only in the use position of the safety lever with the actuation member. This trigger can be displaced in the use position of the safety lever between an advanced position with the formation engageable with the actuation member but with this actuation member in the closed position, and a drawn-back position with the formation pressing the actuation member of the valve into the open position.

10 Claims, 2 Drawing Figures

HIGH-PRESSURE LIQUID-JET GUN

FIELD OF THE INVENTION

The present invention relates to a high-pressure liquid-jet gun. More particularly this invention concerns such a gun used to project water at extremely high pressure against articles to be cleaned or descaled.

BACKGROUND OF THE INVENTION

Cleaning or descaling operations with a high-pressure liquid-jet are being used ever more widely. The machines operate with extremely high pressure, occasionally in the neighborhood of 1000 bar. A liquid ejected from a liquid-jet gun at such a pressure carries considerable energy and is extremely useful in many cleaning operations, as well as in steel mill descaling operations and even some mining operations.

The use of such extremely high pressure does pose an increased danger to the users of such a liquid-jet gun. Such a gun is normally provided with an elongated pistol-type housing having a pistol grip associated with a large trigger that operates a valve inside the housing. When this trigger is drawn back the valve is opened and the high-pressure liquid jet issues from the tip of the barrel of such a gun. In order to prevent accidental actuation of this trigger, a safety is provided, normally in the form of a laterally displaceable button carried on the housing adjacent the trigger and depressable to prevent drawing-back of the trigger. Thus this safety can be engaged when the gun is not in use to prevent accidental actuation of the trigger.

Such an arrangement has considerable disadvantages. First of all a hurried or careless worker will frequently forget to actuate the safety when the gun is not to be used. Secondly the gun is often itself yanked to pull the high-pressure hose connected to it along as the cleaning operation or the like progresses. In order to gain a good grip the user frequently also grips the trigger, which should during such an operation be held in its advanced position by the safety. As a considerable pull is frequently exerted to move the tubing of such a gun along, the safety mechanism is often excessively loaded and at times broken by the user.

OBJECTS OF THE INVENTION

It is therefore an object of the present invention to provide an improved high-pressure liquid-jet gun.

Another object is to provide such a gun having a safety mechanism which prevents unsafe use or accidental discharge of the gun.

Another object is to provide an improved gun of the above-described type which allows the user to obtain a very good grip on the gun without excessively loading the safety mechanism.

SUMMARY OF THE INVENTION

These objects are attained according to the instant invention in a high-pressure liquid-jet gun of the above-described general type but having a safety lever displaceable on the housing between a safety position relatively far from the housing and a use position relatively close to the housing. Biasing means including a spring urges this safety lever into the safety position. According to this invention the trigger is mounted on the safety lever and has a formation engageable only in the use position of this safety lever with the actuation member. This trigger therefore is displaceable in the use position of the safety lever between an advanced position with the formation engageable with the actuation member and with the actuation member in the closed position and a drawn-back position with the formation engaging the actuation member holding the same in the open position. In the safety position of the safety lever the formation on the trigger cannot engage the actuation member.

In fact according to further features of this invention in the safety position of the lever the trigger is automatically displaced into the drawn-back position, normally flat against the pistol grip of the housing. Thus once the safety lever is released, no latch being provided to hold it in the use position, the trigger lies flat against the pistol grip so that the user can hold the entire gun around the pistol grip, with his or her fingers also holding the trigger.

In accordance with another feature of this invention, the housing of the gun has a forwardly extending barrel and the lever has a front portion extending forwardly and lying flatly against this barrel in the use position of the safety lever. Thus under normal circumstances the user will grasp the barrel and front portion of the lever with one hand and the pistol grip with another, so that the hand grasping the safety lever and the barrel automatically displaces the safety lever into the use position and the hand holding the pistol grip then has ready access to the trigger which is automatically similarly displaced into the advanced position. Two-handed holding of the gun according to this invention is therefore insured. In fact the lever and the trigger are separated so far that it is impossible to displace the lever into the safety position and the trigger into the drawn-back position with the same hand.

According to this invention the upper part of the trigger and lower part of the lever are both U-shaped, the trigger and lever having respective trigger and lever cheeks. The lever cheeks are pivoted at a rear pivot axis on the housing and the trigger cheeks are pivoted on the lever cheeks at a pivot lying somewhat in front of the rear pivot axis. Thus as the lever moves between the safety and use positions the pivot for the trigger will be moved, as will that formation on the trigger that must engage the valve-actuation member to open the valve.

In accordance with this invention the trigger lies flatly against the pistol grip in the drawn-back position. Thus when the user is spraying his or her one hand will be around the barrel, holding the front end of the safety lever flat against it, while the other hand will be holding the trigger flat against the pistol grip. This furnishes two very secure hand-holds which allow the device to be held easily.

In accordance with another feature of this invention the housing is provided with a trigger guard constituted as a front member spaced forwardly from the pistol grip and a strut connecting the lower portion of this front member to the lower portion of the pistol grip. This front member may be formed as a tube containing a tension spring hooked to the safety lever and normally urging the safety lever into the safety position. Such a structure protects the trigger further from unintentional actuation.

SPECIFIC DESCRIPTION

Figure 1:
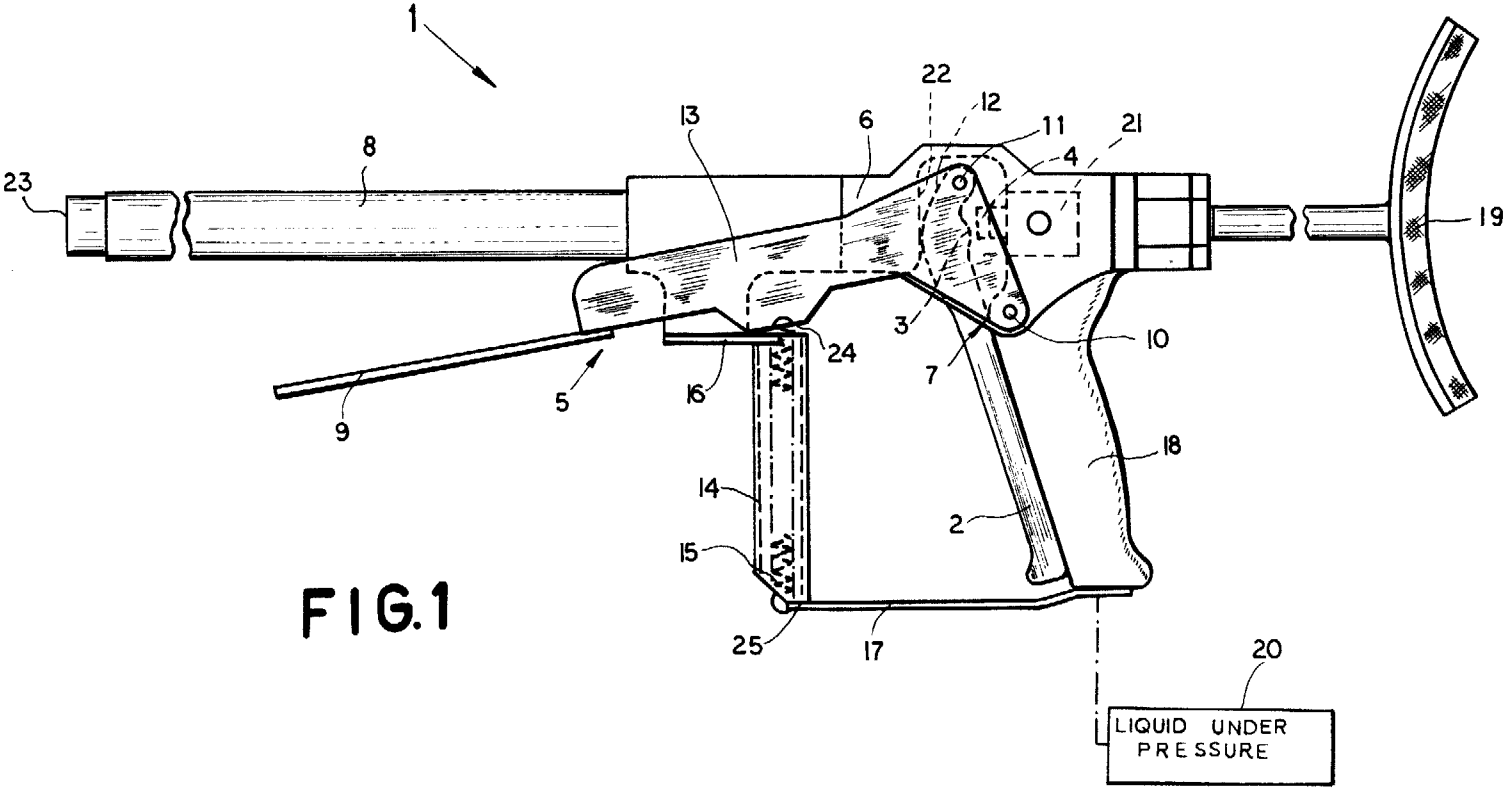
FIG. 1 is a side and partly schematic view of the gun according to this invention with the safety lever in the safety position and the trigger in the drawn-back position.

A liquid-jet gun 1 according to this invention is normally connected to a supply 20 holding a liquid under extremely high pressure. The gun 1 has a housing 6 formed with a throughgoing passage terminating at a front end 23 and provided with a valve 21 having an actuation member or button 4 displaceable backwardly away from the end 23 to open and allow the liquid under pressure from the source 20 to be expelled at high velocity from the end 23. This valve 21 may merely be a pilot valve that controls another valve, or may even be a switch controlling a solenoid valve or the like.

The housing 6 is formed with a pistol grip 18 extending downwardly from the main part of the housing, and with a barrel 8 extending forwardly and defining the end or tip 23. In addition this housing 6 has a rearwardly extending cushioned shoulder or arm rest 19. A trigger guard is formed by a tube 14 extending downwardly from a portion 16 of the housing 6 in front of the pistol grip 18, and a strut 17 extending parallel to the barrel 8 from the lower end of the tube 14 to the lower end of the pistol grip 18.

Figure 2:
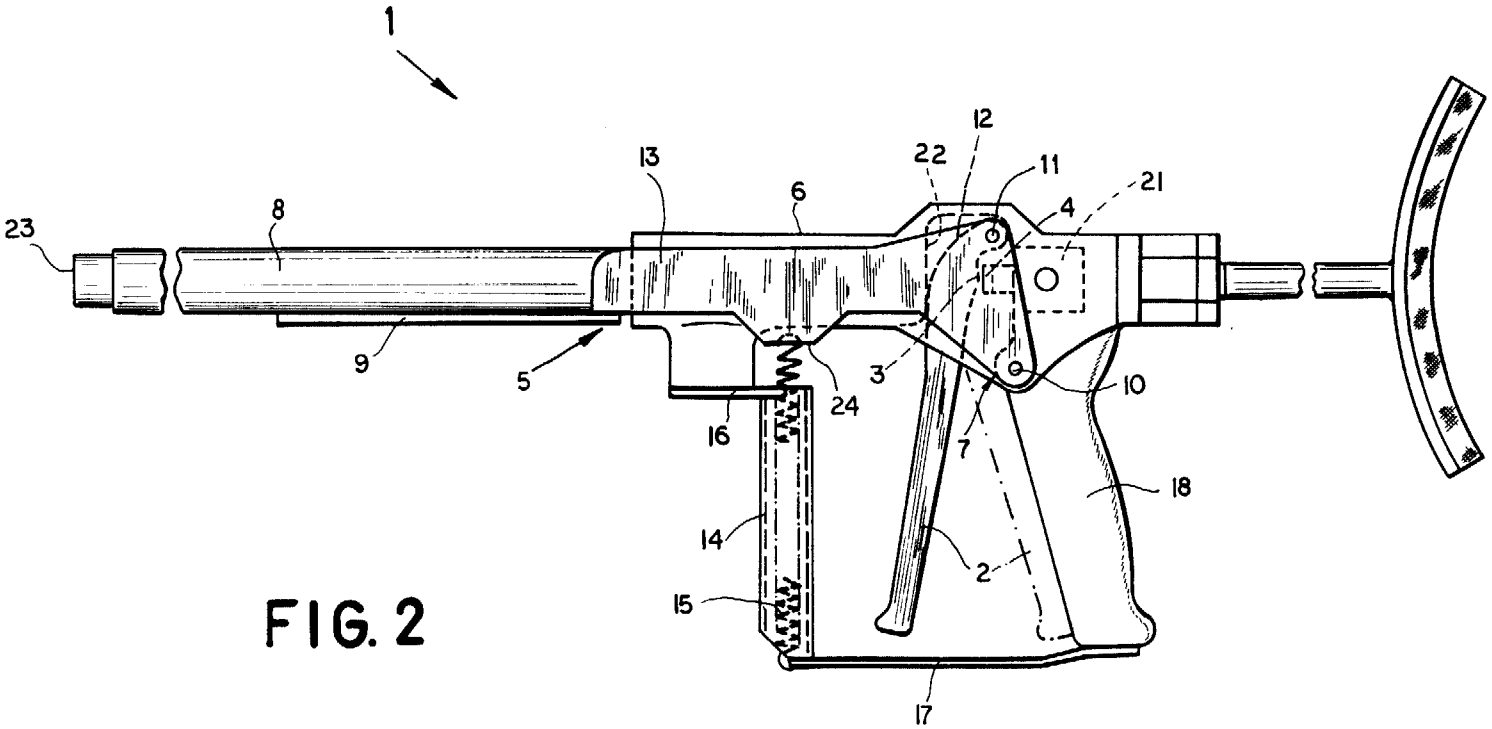
FIG. 2 is a further side view of the gun according to this invention with the safety lever in the safety position.

A trigger 2 is displaceable in the space between the guard tube 14 and the pistol grip 18 between an advanced position shown in solid lines in FIG. 2 in which it is spaced from the tube 14 and from the pistol grip 18, and a drawn-back position shown in solid lines in FIG. 1 and in dot-dash lines in FIG. 2 in which it lies against the pistol grip 18. This trigger 2 is formed with a bump 3 adapted to engage the valve-actuation member or button 4 and push it backwardly to open the valve 21 and allow the liquid under pressure from the source 20 to be emitted from the end 23.

In addition the gun 1 is provided with a safety lever 5 having a flat and forwardly extending front end portion 9 formed as a bar, and a rear end of U-shape formed with a pair of cheeks 13 embracing the housing 6 and pivoted at a pivot axis 10 at the upper end of the pistol grip 18. These two cheeks 13 are bridged by a cross piece 24 on which is hooked one end of a tension spring 15 extending in the tube 14 and hooked at its other end at 25 on the junction between the strut 17 and tube 14. This spring 15 therefore urges the lever into the safety position shown in solid lines in FIG. 1.

The trigger 2 is similarly forked at its top and has two cheeks 12 each pivoted at 11 on a respective cheek 13 of the lever 5. The pivot 11 lies approximately one-sixth of the distance between the cross piece 24 and the pivot 10 toward the front, so that a six-to-one mechanical advantage is effective on the trigger 2 by the spring 15 to pull its pivot downwardly.

The trigger 2 can therefore move as shown in FIG. 2 in the use position of the lever 5 between the advanced or forward position in which the forwardly spring-biased button 4 engages the bumper formation 3 and presses the front surfaces of the cheeks 12 against a surface 22 of the housing 6, and a rear position in which the front surfaces of the cheeks 12 are spaced from the surface 22 and the bumper abutment 3 displaces the valve actuation member 4 backwardly against the force of its spring into a position in which it opens the valve 21. In the safety position of the lever 5, that is when the lever 5 is spaced from the barrel 8, the forwardly curved edges of the cheeks 12 engage the surface 22 and cam the trigger 2 backwardly so that it lies against the pistol grip 18 and in particular bears against an abutment 7 formed on this pistol grip 7. In this position the bump or formation 3 on the back of the cheeks 12 cannot engage the button 4 and cannot, therefore, actuate the valve 21. Furthermore in this safety position of the lever 5 its crosspiece 24 lies on the support portion 16 of the housing 6, pulled thereagainst by the spring 15, so that this lever 5 also lies in a stable position.

Thus with the system according to the instant invention it is only possible to open the valve 21 and to squirt liquid from the end 23 when the lever 5 is in the use position flat against the barrel 8. Thus the user must normally grip the front end part 9 of the lever 5 and the barrel 8 in one hand, holding the two tightly together, while drawing the trigger 2 back against the handle 8 and abutment 7 with the other hand. The lever 5 and trigger 2 are constructed so that it is impossible to move the lever 5 into the use position and the trigger 2 into the drawn-back position with the same hand. For this reason the device will always be operated only when held securely in the two hands of the user. The barrel 8 of the gun 1 should normally be gripped tightly during use, so that holding the portion 9 of the lever 5 against it represents little additional effort for the user.

Similarly once the lever 5 has been released it will be pulled by the spring 15 into the safety position shown in FIG. 1. In this position the trigger 2 will lie flatly against the pistol grip 18, without actuation of the valve 21. Thus in this position, with the lever 5 in the safety position and the trigger 2 in the drawn-back position, the user can easily hold the gun 1, even with his or her fingers around the trigger 2. This is often necessary as a hose leading to the source 20 is normally connected to the lower end of the handle 18, so that if the user chooses to reposition himself or herself it is necessary to pull this hose forcibly along, a chore which is much easier to do when one is able to grip the pistol grip 18 tightly.

We claim:

1. A high-pressure liquid-jet gun comprising:

a housing;

valve means including an actuation member on said housing displaceable between a closed position and an open position for releasing a liquid from an end of said housing on displacement of said actuation member into said open position;

a safety lever on said housing displaceable between a safety position relatively far from said housing and a use position relatively close to said housing;

biasing means urging said safety lever into said safety position; and a trigger mounted on said safety lever and having a formation engageable in said use position of said safety lever with said actuation member, said trigger being displaceable in said use position of said safety lever between an advanced position with said formation engageable with said actuation member and with said actuation member in said closed position, and a drawn-back position with said formation engaging said actuation member and holding same in said open position, said formation being unengageable with said actuation member in said safety position of said lever.

2. A high-pressure liquid-jet gun comprising:

a housing;

means including an actuation member on said housing displaceable between a closed position and an open position for releasing a liquid from an end of said housing on displacement of said actuation member into said open position;

a safety lever on said housing displaceable between a safety position spaced from said housing and a use position relatively close to said housing;

a trigger pivoted on said safety lever and engageable in said use position thereof with said actuation member, said trigger being displaceable in said use position of said safety lever between an advanced position with said actuation member in said closed position and a drawn-back position with said actuation member in said open position; and biasing means urging said safety lever into said safety position.

3. The gun defined in claim 2 further comprising means urging said actuation member into said closed position.

4. The gun defined in claim 3 wherein said means including said actuation member also includes a valve connectable in a high-pressure line and only open in said open position of said actuation member.

5. The gun defined in claim 2 wherein said pistol has a handgrip against which said trigger lies in said drawn-back position and from which it is spaced in said advanced position.

6. The gun defined in claim 5 wherein said housing has a barrel extending toward and defining said end, said lever lying against said barrel in said use position, said lever and trigger being spaced so far apart that they cannot be displaced into their respective use and drawn-back positions by one hand at the same time.

7. The gun defined in claim 5 wherein said housing includes a trigger guard, said biasing means including a spring engaged between said guard and said safety lever.

8. The gun defined in claim 2 wherein said lever and said trigger are both at least partly U-shaped and have respective pairs of trigger and lever cheeks, said lever cheeks being pivoted on opposite sides of said housing and said trigger cheeks being pivoted on respective lever cheeks.

9. The gun defined in claim 2 wherein said trigger has a formation engageable in said use position of said lever with said actuation member and unengageable with said actuation member in said safety position of said lever.

10. The gun defined in claim 2 wherein said lever and said trigger are both at least partly U-shaped and have respective pairs of trigger and lever cheeks, said lever cheeks being pivoted at a back pivot axis relatively far from said end on opposite sides of said housing and said trigger cheeks being pivoted at a front pivot axis closer to said end than said back axis on respective lever cheeks.

* * * * *